US011142715B2

(12) United States Patent
Gunawan et al.

(10) Patent No.: US 11,142,715 B2
(45) Date of Patent: Oct. 12, 2021

(54) AMINO ALKANEDIOLS AND CARBOXYLATE SALTS AS ADDITIVES FOR IMPROVING FUEL EFFICIENCY

(71) Applicants: Chevron U.S.A. Inc., San Ramon, CA (US); Chevron Oronite Company LLC, San Ramon, CA (US)

(72) Inventors: Theresa Liang Gunawan, Emeryville, CA (US); Richard Eugene Cherpeck, Cotati, CA (US); Amir Gamal Maria, Fremont, CA (US)

(73) Assignees: CHEVRON U.S.A. INC., San Ramon, CA (US); CHEVRON ORONITE COMPANY LLC, San Ramon, CA (US)

( * ) Notice: Subject to any disclaimer, the term of this patent is extended or adjusted under 35 U.S.C. 154(b) by 0 days.

(21) Appl. No.: 16/674,069

(22) Filed: Nov. 5, 2019

(65) Prior Publication Data

US 2020/0140771 A1 May 7, 2020

Related U.S. Application Data

(60) Provisional application No. 62/756,891, filed on Nov. 7, 2018.

(51) Int. Cl.

| | |
|---|---|
| ***C10L 1/222*** | (2006.01) |
| ***C10M 133/08*** | (2006.01) |
| ***C10M 169/04*** | (2006.01) |
| ***C10L 10/08*** | (2006.01) |
| ***C10N 30/00*** | (2006.01) |
| ***C10N 40/25*** | (2006.01) |
| ***C10N 30/06*** | (2006.01) |

(52) U.S. Cl.

CPC ..... *C10L 1/2225* (2013.01); *C10L 10/08* (2013.01); *C10M 133/08* (2013.01); *C10M 169/04* (2013.01); *C10L 2200/0423* (2013.01); *C10L 2200/0446* (2013.01); *C10L 2230/22* (2013.01); *C10L 2270/023* (2013.01); *C10L 2270/026* (2013.01); *C10M 2203/003* (2013.01); *C10M 2207/122* (2013.01); *C10M 2207/126* (2013.01); *C10M 2215/042* (2013.01); *C10M 2215/26* (2013.01); *C10N 2030/06* (2013.01); *C10N 2030/54* (2020.05); *C10N 2040/25* (2013.01); *C10N 2040/255* (2020.05)

(58) Field of Classification Search

CPC ..... C10L 1/14; C10L 1/1881; C10L 1/225; C10L 10/08; C10L 10/14; C10L 2200/0423; C10L 2200/0446; C10L 2230/14; C10L 2230/22; C10L 2270/02; C10L 2270/023; C10L 2270/026; C10M 133/08; C10M 141/06; C10M 169/04; C10M 2203/003; C10M 2207/122; C10M 2207/126; C10M 2215/042; C10M 2215/26; C10N 2030/06; C10N 2030/08; C10N 2030/54; C10N 2040/25; C10N 2040/255

See application file for complete search history.

(56) References Cited

U.S. PATENT DOCUMENTS

| | | | | |
|---|---|---|---|---|
| 3,281,358 | A | 10/1966 | Furey | |
| 3,442,630 | A | 5/1969 | Weldon et al. | |
| 3,696,048 | A | 10/1972 | Hausler et al. | |
| 3,756,793 | A | 9/1973 | Robinson | |
| 4,191,537 | A | 3/1980 | Honnen et al. | |
| 4,412,845 | A | 11/1983 | Kaufman et al. | |
| 4,495,076 | A | 1/1985 | Chibnik | |
| 4,537,694 | A | 8/1985 | Horodysky | |
| 4,552,569 | A | 11/1985 | Horodysky | |
| 4,581,039 | A | 4/1986 | Horodysky | |
| 4,684,373 | A | 8/1987 | Vataru et al. | |
| 4,816,037 | A * | 3/1989 | Horodysky | C10M 133/08 44/434 |
| 5,004,478 | A | 4/1991 | Vogel et al. | |
| 5,482,521 | A * | 1/1996 | Avery | C10L 1/221 44/344 |
| 6,051,039 | A | 4/2000 | Sugimoto | |
| 6,328,771 | B1 | 12/2001 | Moreton | |
| 7,867,295 | B2 * | 1/2011 | Schield | C10L 1/1616 44/385 |
| 8,518,128 | B2 | 8/2013 | Reaney et al. | |
| 2002/0095858 | A1 | 7/2002 | Krull et al. | |
| 2004/0010967 | A1 * | 1/2004 | Aradi | C10L 1/221 44/403 |
| 2004/0093790 | A1 | 5/2004 | Baker et al. | |
| 2006/0254127 | A1 | 11/2006 | Breakspear et al. | |
| 2007/0094921 | A1 | 5/2007 | Colucci et al. | |
| 2009/0165364 | A1 | 7/2009 | Karl | |
| 2012/0144731 | A1 | 6/2012 | Bohnke | |
| 2015/0376524 | A1 | 12/2015 | Fang et al. | |

(Continued)

FOREIGN PATENT DOCUMENTS

| | | | |
|---|---|---|---|
| EP | 356726 | A2 | 3/1990 |
| EP | 382159 | A1 | 8/1990 |
| EP | 798364 | A1 | 10/1997 |
| EP | 1230330 | A1 | 8/2002 |
| EP | 1669433 | A1 | 6/2006 |
| WO | 9827184 | A1 | 6/1998 |
| WO | 2012080168 | A1 | 6/2012 |

OTHER PUBLICATIONS

International Search Report, dated Apr. 1, 2020, during the prosecution of International Application No. PCT/IB2019/059475.

(Continued)

*Primary Examiner* — James C Goloboy

(57) ABSTRACT

Friction modifier and compositions containing the friction modifier as a fuel additive are provided. Methods for improving fuel efficiency using these compositions are also provided.

31 Claims, No Drawings

(56) References Cited

U.S. PATENT DOCUMENTS

| | | | |
|---|---|---|---|
| 2017/0166826 | A1 | 6/2017 | Culley et al. |
| 2018/0127675 | A1 | 5/2018 | Culley et al. |

OTHER PUBLICATIONS

Written Opinion of the International Searching Authority, dated Apr. 1, 2020, during the prosecution of International Application No. PCT/IB2019/059475.

* cited by examiner

AMINO ALKANEDIOLS AND CARBOXYLATE SALTS AS ADDITIVES FOR IMPROVING FUEL EFFICIENCY

TECHNICAL FIELD

This disclosure relates to fuel or lubricating oil additives and compositions comprising the additives that improve engine fuel economy by reducing friction and/or reducing wear.

BACKGROUND

In a typical fuel-based internal combustion engine, less than 40% of the fuel's energy is converted to mechanical power. From there, roughly one-third of the converted mechanical power is lost due to friction. To counteract this loss in fuel efficiency, fuel or lubricating oil compositions can contain additives that reduce friction ("friction modifiers") in order to increase fuel efficiency. Friction modifiers may also serve to protect high-pressure fuel pumps and injectors from wear caused by fuel.

There are several classes of friction modifiers, the main class being organic friction modifiers. Organic friction modifiers are generally long slender molecules that have a polar head attached to a long hydrocarbon chain. The polar head is attracted to metal and allows the friction modifier to anchor to a metal surface while the hydrocarbon chain is left perpendicular to the surface thereby preventing asperity contact and reduce friction and/or wear.

Among organic friction modifiers, certain fatty acids and their derivatives (esters and amides) are commonly used. These include derivatives of glycerol such as glycerol monooleate (GMO or "glymo"). Due to the fatty and sometimes waxy nature of fatty acids and their derivatives, concentrated additive packages containing such materials is susceptible to formation of solids, sediments and/or thick gels in an additive packages containing these materials. This non-ideal low temperature storage stability results in poor handling characteristics of packages containing these additives, especially in regions where the packages may be regularly exposed to cooler temperatures.

It is also common to add a separate anti-wear additive (particularly to lubricating oils) to reduce the effects of friction on hard surfaces. The most ubiquitous or widely-used anti-wear additive is zinc dialkyldithiophosphates (ZDDP). ZDDP is a versatile compound often used in formulated oils as anti-fatigue, anti-wear, and extreme pressure additives. Although the advantages of zinc-based additives typically outweigh the risks, the disadvantage of ZDDP is its tendency to corrode certain metals. ZDDP is also generally considered non-biodegradable. Moreover, additives containing metal typically generate ash which is acceptable in small amounts when generated from lubricating oils but much less so when generated from fuels. More and more, regulatory agencies are seeking to curtail or eliminate negative environmental impact from automotive engines. Therefore, there is a need to develop a more environmentally-friendly friction modifier additive for fuels that is easy to formulate and displays superior low temperature stability.

SUMMARY

This disclosure relates to fuel or lubricating oil additives and compositions comprising the additives for internal combustion engines and methods for improving engine fuel efficiency.

In one aspect, there is provided a fuel composition comprising (1) greater than 50 wt. % of a hydrocarbon fuel boiling in gasoline or diesel range and (2) a minor amount of one or more primary or secondary amino alkanediol or an alkyl carboxylic acid salt of the primary or secondary amino alkanediol.

In another aspect, there is provided a fuel composition comprising (1) greater than 50 wt. % of a hydrocarbon fuel boiling in gasoline or diesel range and (2) a minor amount of an alkyl carboxylic acid salt of the primary or secondary amino alkanediol, wherein the primary or secondary amino alkanediol is

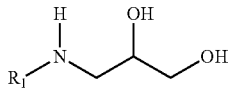

wherein $R_1$ is an H or a saturated or unsaturated aliphatic group.

In a further aspect, there is provided a method for improving fuel economy in an internal combustion engine, the method comprising supplying to the engine a fuel composition comprising (1) greater than 50 wt. % of a hydrocarbon fuel boiling in the gasoline or diesel range and (2) a minor amount of one or more primary or secondary amino alkanediol or the alkyl carboxylic acid salt of the primary or secondary amino alkanediol.

In yet a further aspect, there is provided a lubricating oil composition comprising (1) greater than 50 wt. % of a base oil and (2) a minor amount of one or more primary or secondary amino alkanediol or an alkyl carboxylic acid salt of the primary or secondary amino alkanediol.

In still a further aspect, there is provided a method of improving fuel efficiency of an internal combustion engine, the method comprising: supplying to the engine a lubricating oil composition comprising (1) greater than 50 wt. % of a base oil and (2) a minor amount of one or more primary or secondary amino alkanediol or an alkyl carboxylic acid salt of the primary or secondary amino alkanediol.

DETAILED DESCRIPTION

Definitions

In this specification, the following words and expressions, if and when used, have the meanings ascribed below.

The term "friction modifier" or related term refers to a composition that changes frictional characteristics between surfaces. The term "anti-wear additive" refers to a composition that reduces surface damage cause by friction. It is not uncommon for an additive to have both friction modifying and wear reducing properties.

An "engine" or a "combustion engine" or related term is a heat engine where the combustion of fuel occurs in a combustion chamber. An "internal combustion engine" is a heat engine where the combustion of fuel occurs in a confined space ("combustion chamber").

"Gasoline" or "gasoline boiling range components" or related term refers to a composition containing at least predominantly $C_4$-$C_{12}$ hydrocarbons. In one embodiment, gasoline or gasoline boiling range components is further defined to refer to a composition containing at least predominantly $C_4$-$C_{12}$ hydrocarbons and further having a boiling range of from about 37.8° C. (100° F.) to about 204° C. (400° F.). In an alternative embodiment, gasoline or gasoline boiling range components is defined to refer to a composition containing at least predominantly $C_4$-$C_{12}$ hydrocarbons, having a boiling range of from about 37.8° C. (100° F.) to about 204° C. (400° F.), and further defined to meet ASTM D4814.

The term "diesel" or related term refers to middle distillate fuels containing at least predominantly $C_{10}$-$C_{25}$ hydrocarbons. In one embodiment, diesel is further defined to refer to a composition containing at least predominantly $C_{10}$-$C_{25}$ hydrocarbons, and further having a boiling range of from about 165.6° C. (330° F.) to about 371.1° C. (700° F.). In an alternative embodiment, diesel is as defined above to refer to a composition containing at least predominantly $C_{10}$-$C_{25}$ hydrocarbons, having a boiling range of from about 165.6° C. (330° F.) to about 371.1° C. (700° F.), and further defined to meet ASTM D975.

The term "oil soluble" means that for a given additive, the amount needed to provide the desired level of activity or performance can be incorporated by being dissolved, dispersed or suspended in an oil of lubricating viscosity. Usually, this means that at least 0.001% by weight of the additive can be incorporated in a lubricating oil composition. The term "fuel soluble" is an analogous expression for additives dissolved, dispersed or suspended in fuel.

The term "aliphatic" or related term refers to non-aromatic groups of hydrocarbons. Aliphatic groups can be saturated or unsaturated, linear or branched, and may be non-aromatic cyclic.

The term "alkyl" or related term refer to saturated hydrocarbon groups, which can be linear, branched, cyclic, or a combination of cyclic, linear and/or branched.

A "minor amount" or related term means less than 50 wt. % of a composition, expressed in respect of the stated additive and in respect of the total weight of the composition, reckoned as active ingredient of the additive.

In the context of hydrocarbon-based formulations (particularly lubricants), the term "ash" or related term refers to metallic compounds remaining after hydrocarbons have been calcinated. This ash is mainly derived from chemicals used in certain additives, as well as solids. The term "ashless" or related terms refers to formulations or additives that do not generate ash or limit generation of ash. Ashless additives are generally free of metals (including boron), silicon, halogen, or contain these elements in concentrations below typical instrument detection limits.

An "analog" or related term is a compound having a structure similar to another compound but differing from it in respect to a certain component such as one or more atoms, functional groups, substructures, which are replaced with other atoms, groups, or substructures.

A "homolog" or related term is a compound belonging to a series of compounds that differ from each other by a repeating unit. Alkanes are examples of homologs. For example, ethane and propane are homologs because they differ only in the length of a repeating unit (—$CH_2$—). A homolog may be considered a specific type of analog.

A "derivative" or related term is a compound that is derived from a similar compound via a chemical reaction (e.g., acid-base reaction, hydrogenation, etc.). In the context of substituent groups, a derivative may be a combination of one or more moiety. For example, a phenol moiety may be considered a derivative of aryl moiety and hydroxyl moiety. A person of ordinary skill in the related art would know the metes and bounds of what is considered a derivative.

INTRODUCTION

Most gasoline detergents and dispersants do not display appreciable friction reduction properties when utilized as lower concentration additives in fuels. When these additives are used in higher concentrations, friction reduction is observed but with harmful unintended effects such as unacceptable levels of deposits in the combustion chamber. In an effort to mitigate the harmful effects, friction modifiers can be added to reduce engine friction and increase fuel economy. Some friction modifier also have anti-wear properties and protect the surfaces of the engine from frictional wear.

Traditionally, an ester of a fatty acid and glycerol such as glycerol monooleate (GMO) as well as an amide of a fatty acid and an amine have been employed as friction modifier compounds. However, the glycerol monoester compounds and the fatty amides can have solidification issues (even at ambient temperatures) making handling of these compounds particularly difficult out in field (e.g., storage, transport, etc.). These friction modifiers are difficult to formulate into additive concentrates that remain fluid and homogeneous at low temperatures. This difficulty in preparing friction modifiers can be further exacerbated by detergent additives that are typically used in fuel additive concentrates. Since additive concentrates are usually added to blend fuel additive components into the fuel, it is essential that fuel additive concentrates be homogeneous and remain fluid at low temperatures (down to about −20° C. or lower) to allow for easy handling.

Friction Modifiers

Provided herein are friction modifiers that are useful as fuel or lubricating oil additives. While friction modifiers have traditionally been used as additives in lubricating oil, the design of modern gasoline engines provide an opportunity for fuel additives to assist lubricants in modifying friction.

In engines, the friction modifiers of the present invention reduce friction and/or reduce effect of wear on various engine surfaces. The friction modifier additive can be used generally in internal combustion engines that burn liquid fuel, especially spark-ignited gasoline engines that are carbureted, port-fuel injected (PFI), direct-injected gasoline (DIG), and diesel engines. These compositions can increase overall fuel economy of the internal combustion engine.

The friction modifier includes a primary or secondary amino alkanediol according to a generalized structure shown in Formula 1 or an analog, a homolog, or a derivative thereof. According to another embodiment, the friction modifier is alkyl carboxylic acid salt of the primary or secondary amino alkanediol or an analog, a homolog, or a derivative thereof.

Without being limited by theory, the additives of the present invention have favorable friction modification and/or anti-wear properties. Additionally, the additives of the present invention have superior cold temperature compatibility (Tables 1A-1B). This allows for easy handling of these compositions, particularly in concentrate forms and in cold weather areas. Friction modifiers often assists in maintaining a fluid film or coat the surface of a material (usually metal in engines) that has a much lower coefficient of friction than a bare metal would otherwise. Anti-wear additives often take effect when an oil film is compromised and insufficient to keep two surfaces in a state of hydrodynamic lubrication and enter into boundary lubrication.

Amino Alkanediol

The amino alkanediol of this disclosure are ashless and compositionally limited to elements: C, N, O, and H. In some cases, trace amounts of heteroatoms (non-C, N, O, H) may be acceptable. The general structure of the amino alkanediol (Formula 1) is given by Formula 1

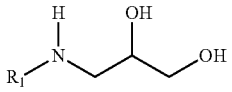

wherein $R_1$ is an H or a saturated or unsaturated aliphatic group, wherein main carbon backbone of $R_1$ is between 1 to 25 carbons, 2 to 20 carbons, 3 to 15 carbons, 4 to 10 carbons, or the like. Suitable aliphatic groups include linear or branched versions of the following aliphatic groups: pentyl (Formula 1A), hexyl (Formula 1B), heptan-2-yl (Formula 1C), octyl (Formula 1D), oleyl (Formula 1E), 2-methylhexyl (Formula 1F), 2-ethylhexyl (Formula 1G), H (Formula 1H), 4-methylhexyl (Formula 11) and the like.

Formula 1A

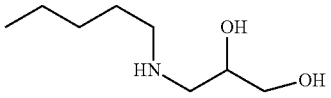

Formula 1B

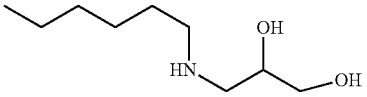

Formula 1C

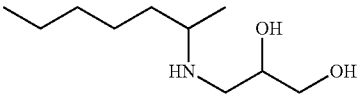

Formula 1D

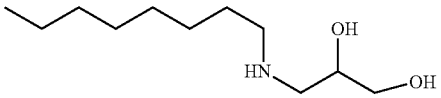

Formula 1E

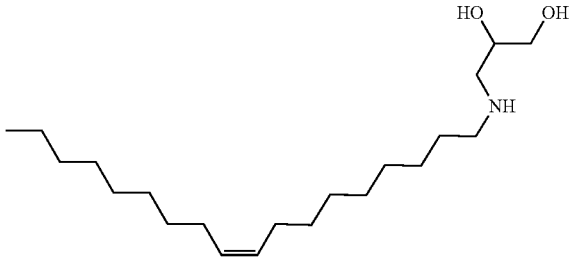

Formula 1F

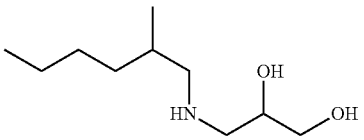

Formula 1G

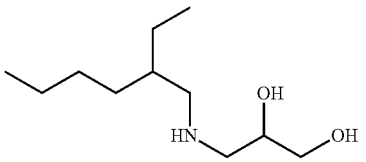

Formula 1H

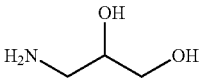

-continued

Formula 1I

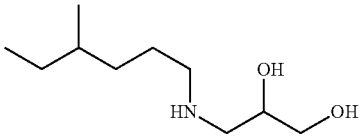

Alkyl Carboxylic Acid

The alkyl carboxylic acid of this disclosure are ashless and compositionally limited to elements: C, N, O, and H. In some cases, trace amounts of heteroatoms (non-C, N, O, H) may be acceptable. The general structure of the alkyl carboxylic acid is given by Formula 2:

Formula 2

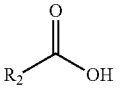

wherein $R_2$ is an alkyl group, wherein the main backbone chain of $R_2$ is between 1 to 25 carbons, 2 to 20 carbons, 3 to 15 carbons, 4 to 10 carbons, or the like. Suitable alkyl carboxylic acids include the following: 2-ethyl hexanoic acid (Formula 2A), 2-propyl hexanoic acid (Formula 2B), 2-ethyl heptanoic acid (Formula 2C), 2-propyl heptanoic acid (Formula 2D), butyric acid (Formula 2E), hexanoic acid (Formula 2F), 3-methylhexanoic acid (Formula 2G), 2-methyloctanoic acid (Formula 2H), 2-ethylnonanoic acid (Formula 21).

Formula 2A

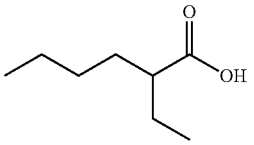

Formula 2B

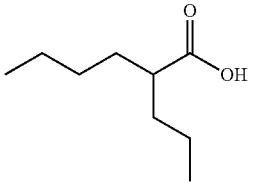

Formula 2C

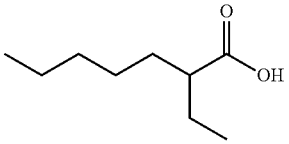

Formula 2D

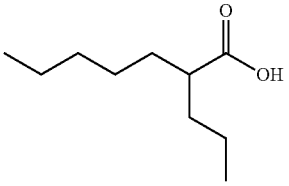

Formula 2E

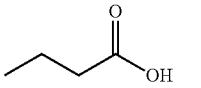

-continued

Formula 2F

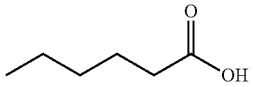

Formula 2G

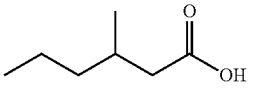

Formula 2H

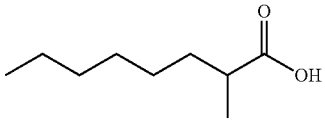

Formula 2I

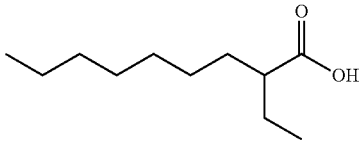

Alkyl Carboxylic Acid Salt of the Primary or Secondary Amino Alkanediol

The alkyl carboxylic acid salt of the primary or secondary amino alkanediol is the salt of an amino alkanediol coordinated to an alkyl carboxylate. The salt can be synthesized by a relatively straightforward 2-step reaction. The synthesis of the 2-ethyl hexanoic acid salt of amino heptanyl propanediol (AHPD) is shown below for illustrative purposes and not intended to be limiting. Other synthesis routes may be contemplated to obtain the desired alkyl carboxylic acid salt of the primary or secondary amino alkanediol.

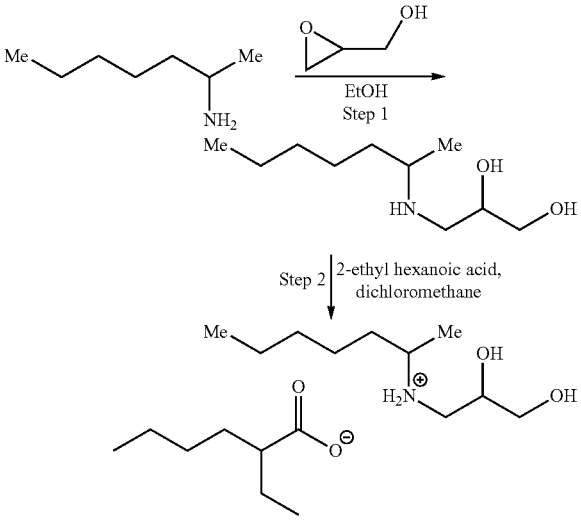

Formula 3

The first step (Step 1) involves reacting 1 equivalent of aminopropanediol with 1 equivalent glycidol in the presence of ethanol solvent. Other suitable solvents include glycerol, propylene, glycol, glycol ether, ethylene glycol monobutyl ether, and the like. In Step 2, the resulting product from step 1 is allowed to blend with 2-ethyl hexanoic acid in the presence of dichloromethane solvent to form the aminopropanediol carboxylate salt. Other suitable solvents include benzene, toluene, xylene, hexane, chlorobenzene, methylene chloride, chloroform, dichloroethane and the like.

Performing the above reaction with octadecenyl amino propanediol (OAPD) in place of AHPD generates salt of 2-ethyl hexanoic acid salt and OAPD (Formula 4).

Formula 4

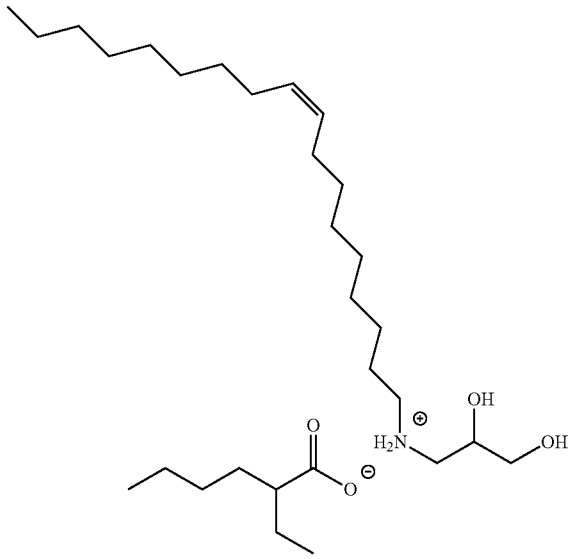

Fuel Compositions

The friction modifiers of the present disclosure may be useful as additives in hydrocarbon fuels to reduce friction and/or reduce wear in order to improve fuel efficiency in internal combustion engines. When used in fuels, the proper concentration of the additive necessary in order to achieve the desired friction reduction and/or wear reduction is dependent upon a variety of factors including the type of fuel used, the presence of other detergents or dispersants or other additives, solubility of the additive in fuel, etc. Generally, the range of concentration of the additives of the present disclosure in hydrocarbon fuel may range from 25 to 5000 parts per million (ppmw) by weight (including, but not limited to, 50 to 4000 ppm, 100 to 3500, 150 to 3000, 200 to 2500, 250 to 2000, 300 to 1500, 350 to 1000 and so forth) or from 0.0025 wt. % to 0.5 wt. % (including, but not limited to, 0.005 to 0.4 wt. %, 0.01 to 0.35 wt. %, 0.015 to 0.3 wt. %, 0.02 to 0.25 wt. %, 0.025 to 0.2 wt. %, 0.03 to 0.15 wt. %, 0.035 to 0.1 wt. %, and so forth). In general, fuel additives should be not be added in an amount greater than fuel soluble. If other friction modifiers are present in the fuel composition, a lesser amount of the additive may be used.

In some embodiments, the compounds of the present disclosure may be formulated as a concentrate using an inert stable oleophilic (i.e., soluble in hydrocarbon fuel) organic solvent boiling in a range of 65° C. to 205° C. An aliphatic or an aromatic hydrocarbon solvent may be used, such as benzene, toluene, xylene, or higher-boiling aromatics or aromatic thinners. Aliphatic alcohols containing 2 to 8 carbon atoms, such as ethanol, isopropanol, methyl isobutyl carbinol, n-butanol and the like, in combination with the hydrocarbon solvents are also suitable for use with the present additives. In the concentrate, the amount of the additive may range from 10 to 70 wt. %, 15 to 60 wt. %, 20 to 50 wt. %, 25 to 45 wt. %, 30 to 40 wt. % or the like.

In gasoline or gasoline fuels, other well-known additives can be employed including oxygenates (e.g., ethanol, methyl tert-butyl ether), other anti-knock agents, and detergents/ dispersants (e.g., hydrocarbyl amines, hydrocarbyl poly (oxyalkylene) amines, succinimides, Mannich reaction products, aromatic esters of polyalkylphenoxyalkanols, or polyalkylphenoxyaminoalkanes). Additionally, low-speed pre-ignition additives, antioxidants, metal deactivators and demulsifiers may be present.

In diesel fuels, other well-known additives can be employed, such as pour point depressants, flow improvers, cetane improvers, and the like. The gasoline fuels employed with the additive composition used in the present invention also include clean burning gasoline where levels of sulfur, aromatics and olefins range from typical amounts to only trace amounts.

A fuel-soluble, non-volatile carrier fluid or oil may also be used with compounds of this disclosure. The carrier fluid is a chemically inert hydrocarbon-soluble liquid vehicle which substantially increases the non-volatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, synthetic polyoxyalkylene-derived oils, such as those described in U.S. Pat. Nos. 3,756,793; 4,191,537; and 5,004,478; and in European Patent Appl. Pub. Nos. 356,726 and 382,159.

The carrier fluids may be employed in amounts ranging from 35 to 5000 ppm by weight of the hydrocarbon fuel (e.g., 50 to 3000 ppm of the fuel). When employed in a fuel concentrate, carrier fluids may be present in amounts ranging from 20 to 60 wt. % (e.g., 30 to 50 wt. %).

Lubricating Oil Compositions

The primary or secondary amino alkanediol or an alkyl carboxylic acid salt of the primary or secondary amino alkanediol of the present disclosure may also be used in lubricating oils to prevent or reduce undesirable ignition events in combustion engines. When employed in this manner, the additives are usually present in the lubricating oil composition in concentrations ranging from 0.001 to 10 wt. % (including, but not limited to, 0.01 to 5 wt. %, 0.2 to 4 wt. %, 0.5 to 3 wt. %, 1 to 2 wt. %, and so forth), based on the total weight of the lubricating oil composition. If other friction modifiers and/or anti-wear additives are present in the lubricating oil composition, a lesser amount of the additive may be used.

Oils used as the base oil will be selected or blended depending on the desired end use and the additives in the finished oil to give the desired grade of engine oil, e.g. a lubricating oil composition having an Society of Automotive Engineers (SAE) Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, or 15W-40.

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making concentrates as well as for making lubricating oil compositions therefrom, may be selected from natural (vegetable, animal or mineral) and synthetic lubricating oils and mixtures thereof.

Definitions for the base stocks and base oils in this disclosure are the same as those found in American Petroleum Institute (API) Publication 1509 Annex E ("API Base Oil Interchangeability Guidelines for Passenger Car Motor Oils and Diesel Engine Oils," December 2016). Group I base stocks contain less than 90% saturates and/or greater than 0.03% sulfur and have a viscosity index greater than or equal to 80 and less than 120 using the test methods specified in Table E-1. Group II base stocks contain greater than or equal to 90% saturates and less than or equal to 0.03% sulfur and have a viscosity index greater than or equal to 80 and less than 120 using the test methods specified in Table E-1. Group III base stocks contain greater than or equal to 90% saturates and less than or equal to 0.03% sulfur and have a viscosity index greater than or equal to 120 using the test methods specified in Table E-1. Group IV base stocks are polyalphaolefins (PAO). Group V base stocks include all other base stocks not included in Group I, II, III, or IV.

Natural oils include animal oils, vegetable oils (e.g., castor oil and lard oil), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (e.g., polybutylenes, polypropylenes, propylene isobutylene copolymers, ethylene-olefin copolymers, and ethylene-alphaolefin copolymers). Polyalphaolefin (PAO) oil base stocks are commonly used synthetic hydrocarbon oil. By way of example, PAOs derived from $C_8$ to $C_{14}$ olefins, e.g., $C_8$, $C_{10}$, $C_{12}$, $C_{14}$ olefins or mixtures thereof, may be utilized.

Other useful fluids for use as base oils include non-conventional or unconventional base stocks that have been processed, preferably catalytically, or synthesized to provide high performance characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

Base oils for use in the lubricating oil compositions of present disclosure are any of the variety of oils corresponding to API Group I, Group II, Group III, Group IV, and Group V oils, and mixtures thereof, preferably API Group II, Group III, Group IV, and Group V oils, and mixtures thereof, more preferably the Group III to Group V base oils due to their exceptional volatility, stability, viscometric and cleanliness features.

Typically, the base oil will have a kinematic viscosity at 100° C. (ASTM D445) in a range of 2.5 to 20 $mm^2/s$ (e.g., 3 to 12 $mm^2/s$, 4 to 10 $mm^2/s$, or 4.5 to 8 $mm^2/s$).

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, dehazing agents, demulsifying agents, friction modifiers, metal deactivating agents, pour point depressants, viscosity modifiers, antifoaming agents, co-solvents, package compatibilizers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt. %, such as about 0.01 to about 10 wt. %.

The following illustrative examples are intended to be non-limiting.

Examples 1-3

A cold temperature test solution was made by blending a friction modifier candidate with an appropriate stock solution. Depending on the test, the stock solution may contain 2-ethylhexanol or may not contain 2-ethylhexanol. The friction modifier and stock solution were added to a 30 mL glass vial in an amount resulting in 19.03 wt % of the final test solution. The vial was capped and shaken by hand until the solution was homogeneous and then placed in a cold well set at −20° C. The test solutions were inspected visually to monitor solution clarity and sediment prevalence at set time intervals for 28 days. A summary of results for AHPD, salt of 2-EH and AHPD, and GMO over a 5 day period can be found in Table 1A. A key of Table 1 results can found in Table 1B. Referring to Table 1B, values 3, 4, 5, and 6 are considered failing ratings for fluid phase while values 2 and 3 are considered failing ratings for sediment. Both AHPD and salt of 2-EH and AHPD performed better than GMO over the 5 day period.

The structure of GMO is shown in Formula 5 below.

Formula 5

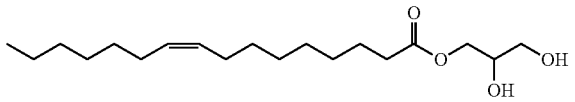

TABLE 1A

Cold Temperature (−20° C.) Compatibility

| | | Additive Conc. | Day 1 (Fluid Phase/ Sediment Rating) | Day 2 | Day 3 | Day 4 | Day 5 |
|---|---|---|---|---|---|---|---|
| Ex. 1 | AHPD (Formula 1C) | 19.03 wt % | 0/0 | 0/0 | 0/0 | 0/0 | 0/0 |
| Ex. 2 | Salt of 2-EH and AHPD (Formula 3) | 19.03 wt % | 0/0 | 0/0 | 0/0 | 0/0 | 0/0 |

TABLE 1A-continued

Cold Temperature (−20° C.) Compatibility

| | | Additive Conc. | Day 1 (Fluid Phase/ Sediment Rating) | Day 2 | Day 3 | Day 4 | Day 5 |
|---|---|---|---|---|---|---|---|
| Ex. 3 | GMO (Formula 5) | 19.03 wt % | 1/0 | 2/4 | Fail | Fail | |

TABLE 1B

Fluid Phase/Sediment Rating

| Fluid Phase | Sediment | Description |
|---|---|---|
| 0 | | Absolutely bright |
| 1 | | Bright |
| 2 | | Slight cloud |
| 3 | | Moderate cloud |
| 4 | | Detectable floc |
| 5 | | Heavy floc |
| 6 | | Heavy cloud |
| | 0 | No sediment |
| | 1 | Very slight sediment |
| | 2 | Slight sediment |
| | 3 | Heavy sediment |

Examples 4-18

Bench test samples comprising various friction modifiers were generated by adding the desired blended friction modifiers to a baseline oil formulation up to the desired wt. %. The final dosage of the friction modifiers in the baseline oil formulation range from 0.25 wt. % to 1.0 wt. %. The baseline oil formulation in a Group 2 base oil consisted of 4.0% polyisobutenyl succinimide, 7.0 mmoles/kg dialkyl zinc dithiophosphate, 48.5 m moles/kg calcium sulfonate detergent, 0.5% alkylated diphenylamine antioxidant, 0.05% foam inhibitor and 0.3% V.I. improver.

The friction modifier containing baseline oils described above were then tested for friction performance in a Mini-Traction Machine (MTM) bench test. The MTM is manufactured and made commercially available by PCS Instruments (London, United Kingdom). The MTM operates with a ball (0.75 inches 8620 steel ball) loaded against a rotating disk (52100 steel). The conditions employ a load of approximately 10-30 Newtons, a speed of approximately 10-2000 mm/s at a temperature of approximately 125-150° C. A wide variety of profiles (test methods) can be set up for different applications.

In this bench test, friction performance was tested by comparing the total area under the second Stribeck curve (mixed lubrication regime) generated with a baseline formulation and the second Stribeck curve generated with the baseline formulation top-treated with a friction modifier. Lower total area values correspond to better friction performance. The MTM results are summarized in Table 2 below.

TABLE 2

| MTM Results | | | |
|---|---|---|---|
| | | Dosage in Baseline Oil (wt %) | MTM results (lower value is better) |
| Ex. 4 | AHPD (Formula 1C) | 0.25 | 11.8 |
| Ex. 5 | GMO (Formula 5) | 0.25 | 44.4 |
| Ex. 6 | OAPD (Formula 1E) | 0.25 | 26.3 |
| Ex. 7 | Salt of 2-EH and AHPD (Formula 3) | 0.25 | 26.4 |
| Ex. 8 | Salt of 2-EH and OAPD (Formula 4) | 0.25 | 54.8 |
| Ex. 9 | AHPD (Formula 1C) | 0.50 | 14.1 |
| Ex. 10 | GMO (Formula 5) | 0.50 | 34.4 |
| Ex. 11 | OAPD (Formula 1E) | 0.50 | 22.3 |
| Ex. 12 | Salt of 2-EH and AHPD (Formula 3) | 0.50 | 11.5 |
| Ex. 13 | Salt of 2-EH and OAPD (Formula 4) | 0.50 | 13.6 |
| Ex. 14 | AHPD (Formula 1C) | 1.0 | 6.8 |
| Ex. 15 | GMO (Formula 5) | 1.0 | 18.3 |
| Ex. 16 | OAPD (Formula 1E) | 1.0 | −1.4 |
| Ex. 17 | Salt of 2-EH and AHPD (Formula 3) | 1.0 | −3 |
| Ex. 18 | Salt of 2-EH and OAPD (Formula 4) | 1.0 | −4.85 |

The invention claimed is:

1. A fuel composition comprising (1) greater than 50 wt. % of a hydrocarbon fuel boiling in gasoline or diesel range and (2) a minor amount of one or more primary or secondary amino alkanediol or an alkyl carboxylic acid salt of the primary or secondary amino alkanediol, wherein the one or more primary or secondary amino alkanediol contains a total of less than 12 carbon atoms.

2. The fuel composition of claim 1, wherein structure of the amino alkanediol is

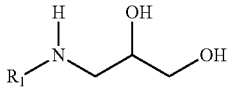

wherein $R_1$ is an H or an aliphatic group.

3. The fuel composition of claim 2, wherein the aliphatic group is one of the following hydrocarbon chain: pentyl group, hexyl group, heptan-2-yl group, octyl group, 2-methylhexyl group, 2-ethylhexyl group, or 4-methylhexyl group.

4. The fuel composition of claim 1, wherein the alkyl carboxylic acid is one of the following acids: 2-ethyl hexanoic acid, 2-propyl hexanoic acid, 2-ethyl heptanoic acid, 2-propyl heptanoic acid, butyric acid, hexanoic acid, 3-methylhexanoic acid, 2-methyloctanoic acid, or 2-ethylnonanoic acid.

5. The fuel composition of claim 1, wherein the amino alkanediol or the alkyl carboxylic acid salt of the primary or secondary amino alkanediol is present in about 25 to 5000 ppm by weight.

6. The fuel composition of claim 1, further comprising: oxygenate, anti-knock agent, detergent, dispersant, friction modifier, antioxidant, metal deactivator, demulsifier, pour point depressant, flow improver, cetane improver, or lubricity additive.

7. The fuel composition of claim 1, wherein the alkyl carboxylic acid salt of the primary or secondary amino alkanediol is compositionally limited to the following elements: C, N, O, and H.

8. A fuel composition comprising (1) greater than 50 wt. % of a hydrocarbon fuel boiling in the gasoline or diesel range and (2) a minor amount of an alkyl carboxylic acid salt of the primary or secondary amino alkanediol, wherein the primary or secondary amino alkanediol is

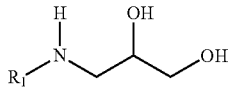

wherein $R_1$ is an H or an aliphatic group, wherein the primary or secondary amino alkanediol contains a total of less than 12 carbon atoms.

9. The fuel composition of claim 8, wherein the aliphatic group is one of the following hydrocarbon chain: propyl group, butyl group, pentyl group, hexyl group, heptyl group, or octyl group.

10. The fuel composition of claim 8, wherein the alkyl carboxylic acid is one of the following acids: 2-ethyl hexanoic acid, 2-propyl hexanoic acid, 2-ethyl heptanoic acid, 2-propyl heptanoic acid, butyric acid, hexanoic acid, 3-methylhexanoic acid, 2-methyloctanoic acid, or 2-ethylnonanoic acid.

11. A method for improving fuel economy in an internal combustion engine, the method comprising supplying to the engine a fuel composition comprising (1) greater than 50 wt. % of a hydrocarbon fuel boiling in gasoline or diesel range and (2) a minor amount of one or more primary or secondary amino alkanediol or an alkyl carboxylic acid salt of the primary or secondary amino alkanediol, wherein the one or more primary or secondary amino alkanediol contains a total of less than 12 carbon atoms.

12. The method of claim 11, wherein structure of the amino alkanediol is

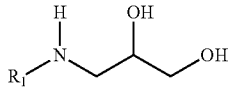

wherein $R_1$ is an H or an aliphatic group.

13. The method of claim 12, wherein the aliphatic group is one of the following hydrocarbon chain: pentyl group, hexyl group, heptan-2-yl group, octyl group, 2 methylhexyl group, 2-ethylhexyl group, or 4-methylhexyl group.

14. The method of claim 11, wherein the alkyl carboxylic acid salt of the primary or second amino alkanediol includes a carboxylate of an alkyl carboxylic acid.

15. The method of claim 14, wherein the alkyl carboxylic acid is one of the following acids: 2-ethyl hexanoic acid, 2-propyl hexanoic acid, 2-ethyl heptanoic acid or 2-propyl heptanoic acid.

16. The method of claim 11, wherein the amino alkanediol or alkyl carboxylic acid salt of the primary or secondary amino alkanediol is present in about 25 to 5000 ppm by weight.

17. The method of claim 11, wherein the fuel composition further comprises:

oxygenate, anti-knock agent, detergent, dispersant, friction modifier, antioxidant, metal deactivator, demulsifier, pour point depressant, flow improver, cetane improver, or lubricity additive.

18. The method of claim 11, wherein alkyl carboxylic acid salt of the primary or secondary amino alkanediol is compositionally limited to the following elements: C, N, O, and H.

19. A lubricating oil composition comprising (1) greater than 50 wt. % of a base oil and (2) a minor amount of one or more primary or secondary amino alkanediol or an alkyl carboxylic acid salt of the primary or secondary amino alkanediol, wherein the one or more primary or secondary amino alkanediol contains a total of less than 12 carbon atoms.

20. The lubricating oil composition of claim 19, wherein structure of the amino alkanediol is

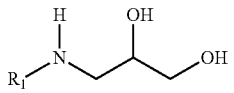

wherein $R_1$ is an H or an aliphatic group.

21. The lubricating oil composition of claim 20, wherein the aliphatic group is one of the following hydrocarbon chain: pentyl group, hexyl group, heptan-2-yl group, octyl group, 2-methylhexyl group, 2-ethylhexyl group, or 4-methylhexyl group.

22. The lubricating oil composition of claim 19, wherein the alkyl carboxylic acid is one of the following acids: 2-ethyl hexanoic acid, 2-propyl hexanoic acid, 2-ethyl heptanoic acid, 2-propyl heptanoic acid, butyric acid, hexanoic acid, 3-methylhexanoic acid, 2-methyloctanoic acid, or 2-ethylnonanoic acid.

23. The lubricating oil composition of claim 19, wherein the amino alkanediol or the alkyl carboxylic acid salt of the primary or secondary amino alkanediol is present in about 0.001 to 10% by weight.

24. The lubricating oil composition of claim 19, wherein the amino alkanediol or the alkyl carboxylic acid salt of the primary or secondary amino alkanediol is present in about 0.5 to 5% by weight.

25. The lubricating oil composition of claim 19, further comprising:

antioxidant, ashless dispersant, anti-wear agent, detergent, rust inhibitor, dehazing agent, demulsifying agent, friction modifier, metal deactivating agent, pour point depressant, viscosity modifier, antifoaming agent, co-solvent, package compatibilizer, corrosion-inhibitor, dye, or extreme pressure agent.

26. The lubricating oil composition of claim 19, wherein the alkyl carboxylic acid salt of the primary or secondary amino alkanediol is compositionally limited to the following elements: C, N, O, and H.

27. A method of improving fuel efficiency of an internal combustion engine, the method comprising:

supplying to the engine a lubricating oil composition comprising (1) greater than 50 wt. % of a base oil and (2) a minor amount of one or more primary or secondary amino alkanediol or an alkyl carboxylic acid salt of the primary or secondary amino alkanediol, wherein the one or more primary or secondary amino alkanediol contains a total of less than 12 carbon atoms.

28. The method of claim 27, wherein the internal combustion engine is spark-ignited.

29. The method of claim 27, wherein structure of the amino alkanediol is

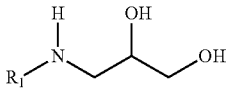

wherein $R_1$ is an H or an aliphatic group.

30. The method of claim 29, wherein the aliphatic group is one of the following hydrocarbon chain: pentyl group, hexyl group, heptan-2-yl group, octyl group, 2-methylhexyl group, 2-ethylhexyl group, or 4-methylhexyl group.

31. The method of claim 27, wherein the alkyl carboxylic acid is one of the following acids: 2-ethyl hexanoic acid, 2-propyl hexanoic acid, 2-ethyl heptanoic acid or 2-propyl heptanoic acid.

* * * * *